US007425796B2

(12) United States Patent
Mizuta

(10) Patent No.: US 7,425,796 B2
(45) Date of Patent: Sep. 16, 2008

(54) PLASMA DISPLAY PANEL AND MANUFACTURING METHOD THEREOF

(75) Inventor: Takahisa Mizuta, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 574 days.

(21) Appl. No.: 11/111,242

(22) Filed: Apr. 20, 2005

(65) Prior Publication Data

US 2005/0231114 A1 Oct. 20, 2005

(30) Foreign Application Priority Data

Apr. 20, 2004 (KR) ..... 10-2004-0026979

(51) Int. Cl.
*H01J 17/49* (2006.01)

(52) U.S. Cl. ..... 313/582; 313/584

(58) Field of Classification Search ..... 313/582, 313/584–587

See application file for complete search history.

(56) References Cited

U.S. PATENT DOCUMENTS

| | | | | |
|---|---|---|---|---|
| 5,661,500 | A * | 8/1997 | Shinoda et al. | 345/60 |
| 6,495,957 | B2 * | 12/2002 | Kurogi et al. | 313/584 |
| 6,707,259 | B2 | 3/2004 | Nagao et al. | |

FOREIGN PATENT DOCUMENTS

| | | |
|---|---|---|
| CN | 1201995 A | 12/1998 |
| JP | 03-077239 | 4/1991 |
| JP | 11-96921 | 4/1999 |
| JP | 2001-35383 | 2/2001 |
| JP | 2002-203486 | 7/2002 |
| JP | 2002-279902 | 9/2002 |
| KR | 2002-0069021 | 8/2002 |
| KR | 10-2004-0002308 | 1/2004 |
| WO | WO 03/032357 A1 | 4/2003 |

OTHER PUBLICATIONS

Patent Abstracts of Japan, Publication No. 11-096921, dated Apr. 9, 1999, in the name of Tetsuyoshi Tomioka et al.
Korean Patent Abstracts, Publication No. 1020040002308 A, dated Jan. 7, 2004, in the name of Oe Dong Kim.
Patent Abstracts of Japan, Publication No. 2001-035383, dated Feb. 9, 2001, in the name of Hiroshi Mori, et al.
Patent Abstracts of Japan for Publication No. 2002-203486; Date of publication of application Jul. 19, 2002, in the name of Satoshi Nakada et al.
Patent Abstracts of Japan for Publication No. 2002-279902; Date of publication of application Sep. 27, 2002, in the name of Yasunobu Hashimoto.
Patent Abstracts of Japan; Publication No. 03-077239; Publication Date Apr. 2, 1991; in the name of Kurai.

* cited by examiner

*Primary Examiner*—Vip Patel
(74) *Attorney, Agent, or Firm*—Christie, Parker & Hale, LLP

(57) ABSTRACT

A plasma display panel includes a first substrate and a second substrate provided opposing one another with a predetermined gap therebetween, a plurality of barrier ribs mounted in the gap between the first and second substrates to define a plurality of discharge cells, a plurality of phosphor layers respectively formed in the discharge cells, a plurality of display electrodes formed on the first substrate along a first direction, and a plurality of address electrodes formed between the first and second substrates along a second direction, which intersects the first direction. The address electrodes are positioned closer to the first substrate than to the second substrate.

25 Claims, 8 Drawing Sheets

PLASMA DISPLAY PANEL AND MANUFACTURING METHOD THEREOF

CROSS REFERENCE TO RELATED APPLICATION

This application claims priority to and the benefit of Korean Patent Application No. 10-2004-0026979 filed on Apr. 20, 2004, in the Korean Intellectual Property Office, the entire content of which is incorporated herein by reference.

BACKGROUND OF THE INVENTION (a) Field of the Invention

The present invention relates to a plasma display panel (PDP) and a method for manufacturing the same.

(b) Description of the Related Art

A PDP is a display device that displays images through excitation of phosphors by plasma discharge. Vacuum ultraviolet (VUV) rays emitted from plasma obtained via gas discharge excite phosphor layers, which then emit visible red (R), green (G), and blue (B) light to thereby form images. The PDP has many advantages including an ability to be made having large screen sizes of 60 inches and greater, a thin profile of 10 cm or less, a wide viewing angle and good color reproduction due to the self-emissive nature of the PDP (similar to a cathode-ray tube), and high productivity and low manufacturing costs as a result of manufacturing processes that are more simple than those involved with liquid crystal displays. As a result, the PDP is experiencing increasingly widespread use in homes and industries.

In a conventional alternating current (AC) PDP, a rear substrate and a front substrate are provided opposing one another with a predetermined gap therebetween. Formed on a surface of the rear substrate opposing the front substrate are a plurality of address electrodes. The address electrodes are formed in a stripe pattern along a first direction. A first dielectric layer is formed on the rear substrate covering the address electrodes, and a plurality of barrier ribs are formed on the first dielectric layer. The barrier ribs are formed either in a stripe pattern along the first direction and at areas between the address electrodes, or in a matrix pattern along the first direction as well as a second direction that is perpendicular to the first direction. Red, green, and blue phosphor layers are respectively formed between adjacent pairs of the barrier ribs.

Formed on a surface of the front substrate opposing the rear substrate are a plurality of display electrodes (sustain and scan electrodes), each comprised of a pair of transparent electrodes and a corresponding pair of bus electrodes. A second dielectric layer and a magnesium oxide (MgO) protection layer are formed (in this order) on the front substrate covering the display electrodes.

Each area between one of the address electrodes and a pair of the display electrodes, and delimited by the intersection (or crossing) of these elements, forms a discharge cell. Several millions of discharge cells can be formed in a matrix configuration by this arrangement. A memory characteristic is utilized to simultaneously drive the millions of discharge cells of the AC PDP.

In more detail, to realize discharge between an X electrode (sustain electrode) and a Y electrode (scan electrode) included in each pair of the display electrodes, a potential difference of a predetermined voltage is required. This potential difference is referred to as a firing voltage Vf. That is, in driving the AC PDP, if an address voltage Va is applied between one of the Y electrodes and one of the address electrodes, address discharge is initiated such that plasma is created in a corresponding discharge cell. Electrons and ions in the plasma migrate toward the electrodes of opposite polarity to thereby realize the flow of current.

However, because the first dielectric layer is formed over the address electrodes, and the second dielectric layer is formed over the display electrodes, most of the migrated space charges accumulate on the first and second dielectric layers, which are opposite in polarity. As a result, a net space potential between the Y electrodes and the address electrodes becomes less than the originally applied address voltage Va to weaken discharge and thereby terminate address discharge.

When the address discharge is terminated, a relatively small number of electrons accumulate toward the X electrodes, while a relatively large number of ions accumulate toward the Y electrodes. The charge accumulated on the second dielectric layer, which covers the X and Y electrodes, is referred to as a wall charge Qw, while the space voltage formed between the X and Y electrodes by the wall charge Qw is referred to as a wall voltage Vw.

Subsequently, if a predetermined discharge sustain voltage Vs is applied between the X electrodes and the Y electrodes, and if a sum of the discharge sustain voltage Vs and the wall voltage Vw (Vs+Vw) becomes larger than the firing voltage Vf, discharge is effected in the corresponding discharge cells. VUV rays generated as a result excite the corresponding phosphor layer such that visible light is emitted through the transparent front substrate.

Alternatively, when there is no address discharge applied between the Y electrodes and the address electrodes (i.e., when there is no application of an address voltage Va), no wall charge is present between the X and Y electrodes, and, ultimately, no wall voltage between the same. Hence, only the discharge sustain voltage Vs that is applied between the X and Y electrodes is formed in the discharge cell, and since this voltage alone is smaller than the firing voltage Vf, no discharge occurs in the gaseous spaces of the X and Y electrodes.

In the PDP operating as described above, many steps are involved between power input and obtaining the display of visible light. Further, the efficiency of converting energy in each of these steps is low. In fact, a conventional CRT has a better overall efficiency (brightness to power consumption ratio) than does a conventional PDP. The low energy efficiency of conventional PDPs is a serious drawback for the PDPs.

SUMMARY OF THE INVENTION

An embodiment of the present invention provides a plasma display panel and a method for manufacturing the same, in which address discharge is possible at a low voltage to thereby reduce power consumption.

In one embodiment of the present invention, a plasma display panel includes a first substrate and a second substrate opposing one another with a predetermined gap therebetween; a plurality of barrier ribs in the gap between the first and second substrates to define a plurality of discharge cells; a plurality of phosphor layers respectively formed in the discharge cells; a plurality of display electrodes on the first substrate along a first direction; and a plurality of address electrodes between the first and second substrates along a second direction, which intersects the first direction. In this embodiment, the address electrodes are positioned closer to the first substrate than to the second substrate.

The address electrodes may be respectively formed in upper regions of the barrier ribs, and may be respectively embedded within the barrier ribs.

The address electrodes may be extended along the barrier ribs corresponding to all of the display electrodes.

Further, the plasma display device may further include a dielectric layer on the first substrate. The address electrodes may be connected to the first substrate via the dielectric layer, and may be closer to the display electrodes than to the first substrate while being electrically isolated from the display electrodes. In addition, the dielectric layer may include a plurality of protrusions, the address electrodes may be respectively embedded within the protrusions, and the address electrodes may be closer to the second substrate than the display electrodes are to the second substrate.

The display electrodes may include a plurality of bus electrodes formed extending along the first direction, and in opposing pairs for each of the discharge cells, and a plurality of transparent electrodes formed on the first substrate and extended toward inner regions of each of the discharge cells from the bus electrodes, a pair of the transparent electrodes opposing one another for each of the discharge cells, each opposing pair of the transparent electrodes having a point symmetry with respect to a center of a corresponding one of the discharge cells Each of the protruding electrodes may include a wide region that contacts a corresponding one of the bus electrodes and extends into one of the discharge cells, and a narrow region extended from the wide region and further into the discharge cell. The wide and narrow regions may form a stepped structure.

Each of the protruding electrodes may include a wide region and a narrow region, the wide region and the narrow opposing each other along a direction of extension of the bus electrodes, the wide region and the narrow region also opposing each other along a direction of extension of the address electrodes. In one embodiment, the wide region has a length along a direction of extension of the address electrodes that is less than a length of the narrow region along the same direction.

Each of the protruding electrodes may include a wide region and a narrow region interconnected via an inclined surface. The inclined surface is inclined with respect to the direction of extension of the bus electrodes and the direction of extension the address electrodes. Each of the inclined surfaces may include a rounded segment, in which the rounded segments for each pair of the protruding electrodes oppose one another.

Opposing pairs of the protruding electrodes may be respectively included in pairs of sustain and scan electrodes, each pair of the sustain and scan electrodes having a point symmetry with respect to a center of a corresponding one of the discharge cells. In addition, the sustain and scan electrodes may have an asymmetrical structure with respect to the direction of extension of the address electrodes, and with respect to the direction of extension of the bus electrodes.

DETAILED DESCRIPTION

Exemplary embodiments of the present invention will now be described with reference to the drawings.

Figure 1:
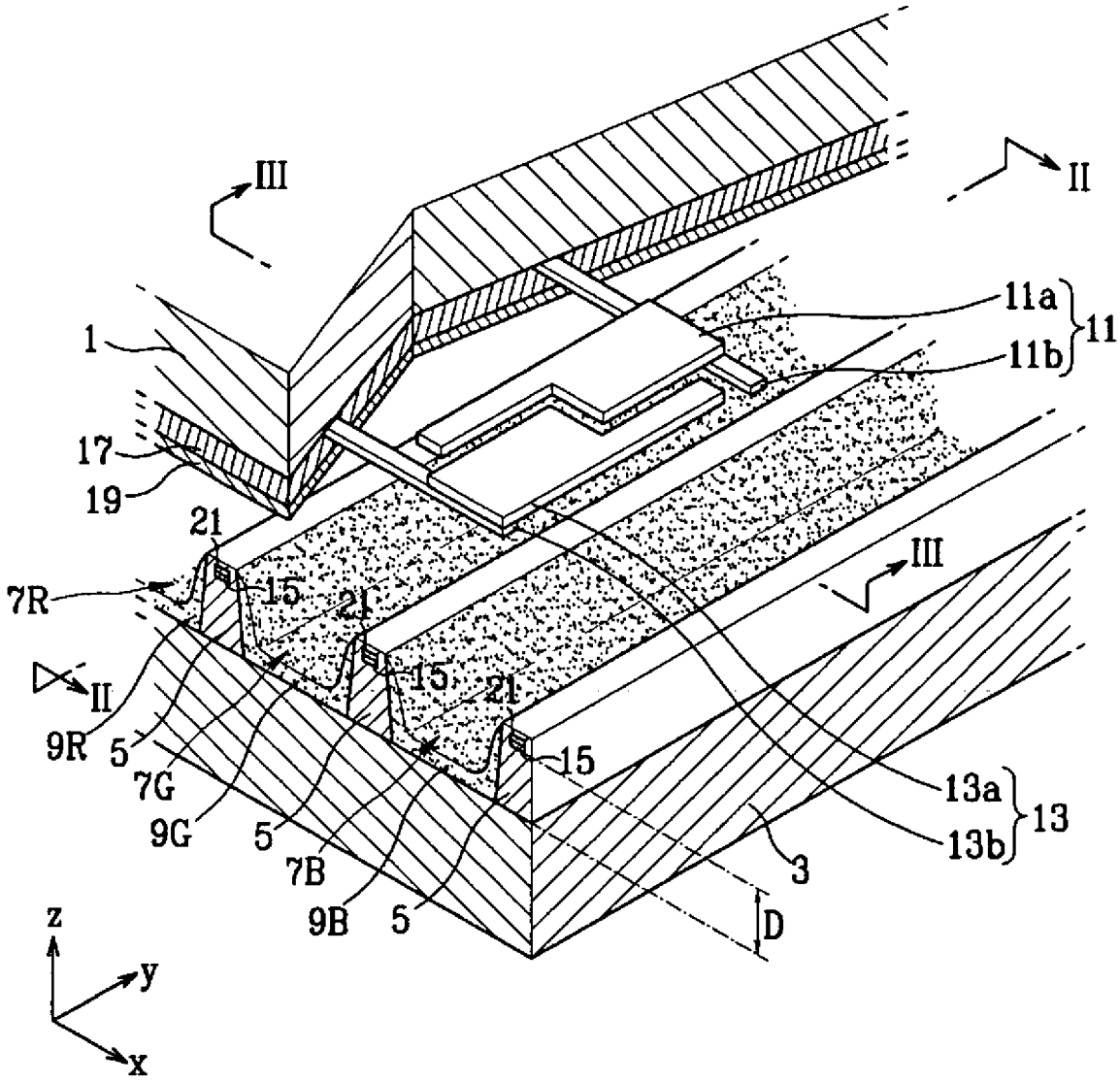
FIG. 1 is a partial perspective view of a plasma display panel according to a first exemplary embodiment of the present invention.

Referring to FIG. 1, a plasma display panel (PDP) according to a first exemplary embodiment of the present invention includes a first substrate 1 and a second substrate 3 sealed opposing one another with a predetermined gap therebetween. A plurality of barrier ribs 5 are formed between the first and second substrates 1, 3. The barrier ribs 5 define a plurality of discharge cells 7R, 7G, 7B. Phosphor layers 9R, 9G, 9B are formed by depositing red (R), green (G), and blue (B) phosphor material between and on inner walls of the barrier ribs 5.

A plurality of display electrodes 11, 13 are formed on the first substrate 1 extended along a first direction (i.e., along direction x of FIG. 1), and a plurality of address electrodes 15 are formed on the second substrate 3 extended along a second direction (i.e., along direction y of FIG. 1), which is perpendicular to the first direction.

The barrier ribs 5 formed between the first and second substrates 1, 3 are mounted parallel to one another such that the discharge cells 7R, 7G, 7B are respectively formed between adjacent ones of the barrier ribs 5. Such a stripe pattern of the barrier ribs 5 is used merely as an example, and the present invention is not thereby limited. For example, a closed matrix configuration may be employed, in which barrier ribs are extended along both the x and y directions intersecting one another.

In FIG. 1, the display electrodes 11, 13 are X, Y electrodes, respectively, in which one of the X (or sustain) electrodes 11 and one of the Y (or scan) electrodes 13 are provided in opposing pairs. Each of the X electrodes 11 includes a bus electrode 11*b* extended along direction x, and a plurality of transparent electrodes 11*a* extended along direction y from the bus electrode 11*b* toward the corresponding one of the Y electrodes 13. Similarly, each of the Y electrodes 13 includes a bus electrode 13*b* extended along direction x, and a plurality of transparent electrodes 13*a* extended along direction y from the bus electrode 13*b* toward the corresponding one of the X electrodes 11.

The transparent electrodes 11*a*, 13*a* function to effect a plasma discharge in the discharge cells 7R, 7G, 7B. To ensure good brightness, in one embodiment, the transparent electrodes 11*a*, 13*a* are made of a transparent material such as indium tin oxide (ITO). The bus electrodes 11*b*, 13*b* compensate for the high resistance of the transparent electrodes 11*a*, 13*a* to thereby maintain a high conductivity levels. In one embodiment, the bus electrodes 11*b*, 13*b* are made of a metal material such as silver (Ag).

The X, Y electrodes 11, 13 are mounted in opposing pairs as described above. The X, Y electrodes 11, 13 are covered by a first dielectric layer 17 and an MgO protection layer 19.

Figure 2:
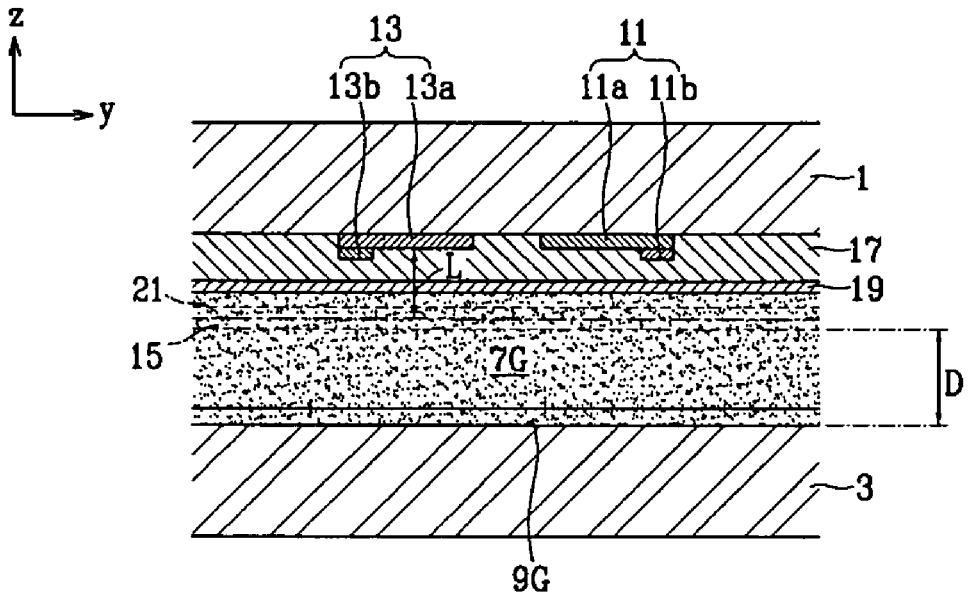
FIG. 2 is a sectional view taken along line 11-11 of FIG. 1.
Figure 3:
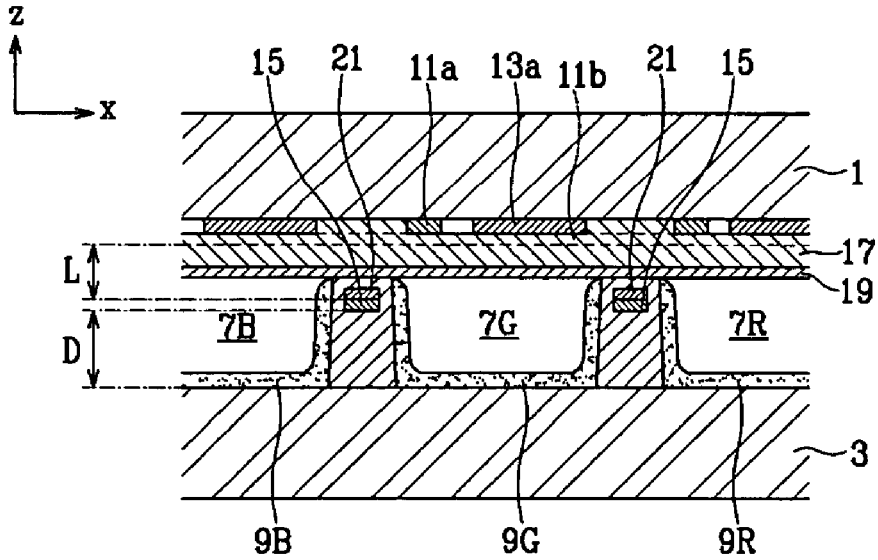
FIG. 3 is a sectional view taken along line 111-111 of FIG. 1.

FIG. 2 is a sectional view taken along line II-II of FIG. 1, and FIG. 3 is a sectional view taken along line III-III of FIG. 1.

With reference to the FIGS. 2 and 3, the address electrodes 15 are formed extended along direction y between the first and second substrates 1, 3. The direction y is perpendicular to the bus electrodes 11*b*, 13*b* of the display electrodes 11, 13, Specifically, the address electrodes 15 are embedded respectively in the barrier ribs 5, which are formed on the second substrate 3. Therefore, rather than being formed directly on the second substrate 3 as in conventional PDPs, the address electrodes 15 of this embodiment are embedded in the barrier ribs 5 at a location such that the address electrodes 15 are spaced away from the inner surface of the second substrate 3 by a distance D. As a result of such a structure, the address electrodes 15 formed in the barrier ribs 5 are positioned closer to the Y electrodes 13 (i.e., by a distance L) than in conventional PDPs. Because of this, the Y electrodes 13 better cooperate with the address electrodes 15 to effect address discharge.

In particular, the reduction in the distance between the address electrodes 15 and the Y electrodes 13 (i.e., the distance L) allows for address discharge to occur at a low voltage, thereby reducing the power consumption of the PDP. The distance L may be further reduced by forming the address electrodes 15 directly on upper surfaces of the barrier ribs 15, that is, on surfaces of the barrier ribs 15 furthermost distal from the second substrate 3. An even lower voltage, therefore, may be used to effect address discharge.

To further enable the address electrodes 15 to generate wall charges needed for plasma discharge to thereby reduce discharge voltage so that discharge current is suppressed and power consumption of the PDP is minimized, second dielectric layers 21 may be respectively formed on the address electrodes 15. Therefore, in one embodiment, only the address electrodes 15 are embedded in the barrier ribs 5, and, in another embodiment, the address electrodes 15 together with the second dielectric layers 21 are embedded in the barrier ribs 5.

In addition, in one embodiment, the address electrodes 15 are extended along the barrier ribs 5 along the whole lengths of the same, thereby opposing all of the display electrodes 11, 13 so that the address electrodes 15 may effect address discharge within the entire lines of the discharge cells 7R, 7G, 7B.

Figure 4:
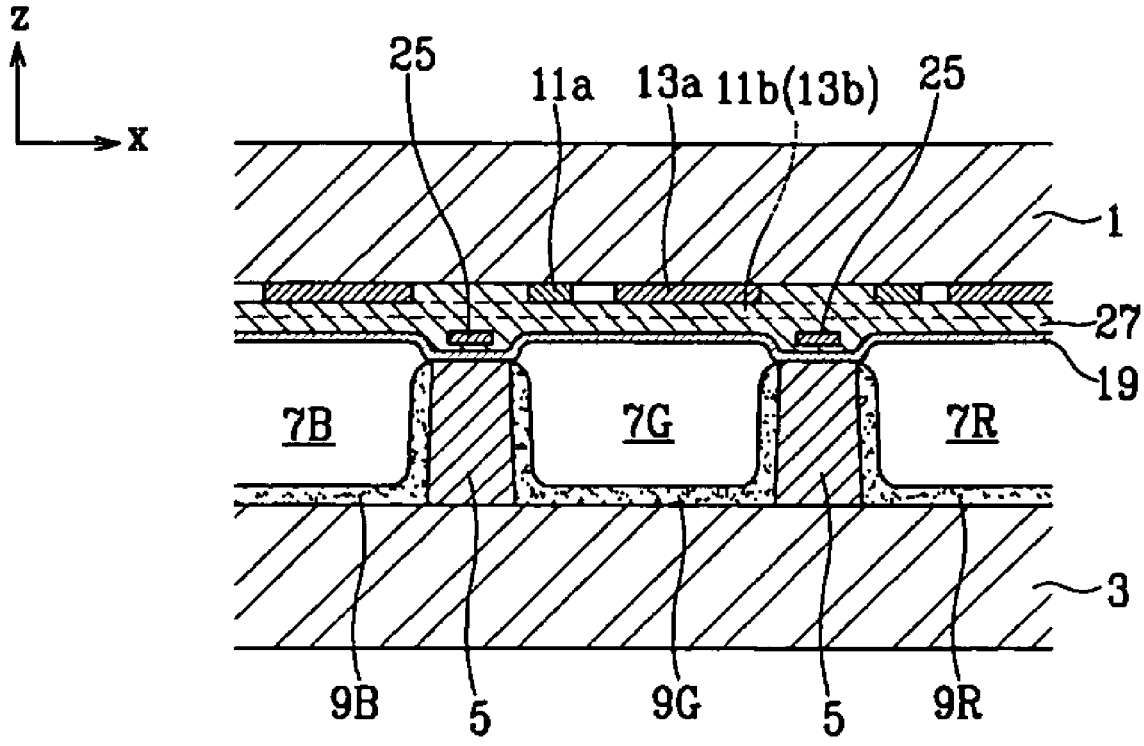
FIG. 4 is a partial sectional view of a plasma display panel according to a modified example of the first exemplary embodiment of the present invention.

FIG. 4 is a partial sectional view of a PDP according to a modified example of the first exemplary embodiment of the present invention.

Address electrodes 25 of the PDP of this modified example are formed on the first substrate 1. That is, the transparent electrodes 11*a*, 13*a* and the bus electrodes 11*b*, 13*b* are formed in this order on the first substrate 1, and a first dielectric layer 27 is formed covering these elements. The address electrodes 25 are formed on the first substrate 1 in a state insulated from the bus electrodes 11*b*, 13*b* and the transparent electrodes 11*a*, 13*a* by the first dielectric layer 27. As shown, the address electrodes 25 are mounted at locations respectively corresponding to the barrier ribs 5. In this embodiment, the locations of the first dielectric layer 27 of the address electrodes 25 are protruded more than surfaces of the first dielectric layer 27 that are located at areas corresponding to the discharge cells 7R, 7G, 7B. With this configuration, gaps are formed between the address electrodes 25 and the Y electrodes 13, which cooperate to effect discharge during address intervals. These gaps allow for smoother address discharge. Furthermore, when compared to the conventional PDP where address electrodes are formed on a second substrate, the distance between the Y electrodes 13 and the address electrodes 25 of this modified example is minimized to thereby allow for address discharge to occur at a low voltage, ultimately resulting in a reduction in the power consumption of the PDP. It is to be noted that this modified example may also be applied to the additional embodiments described below.

Figure 5:
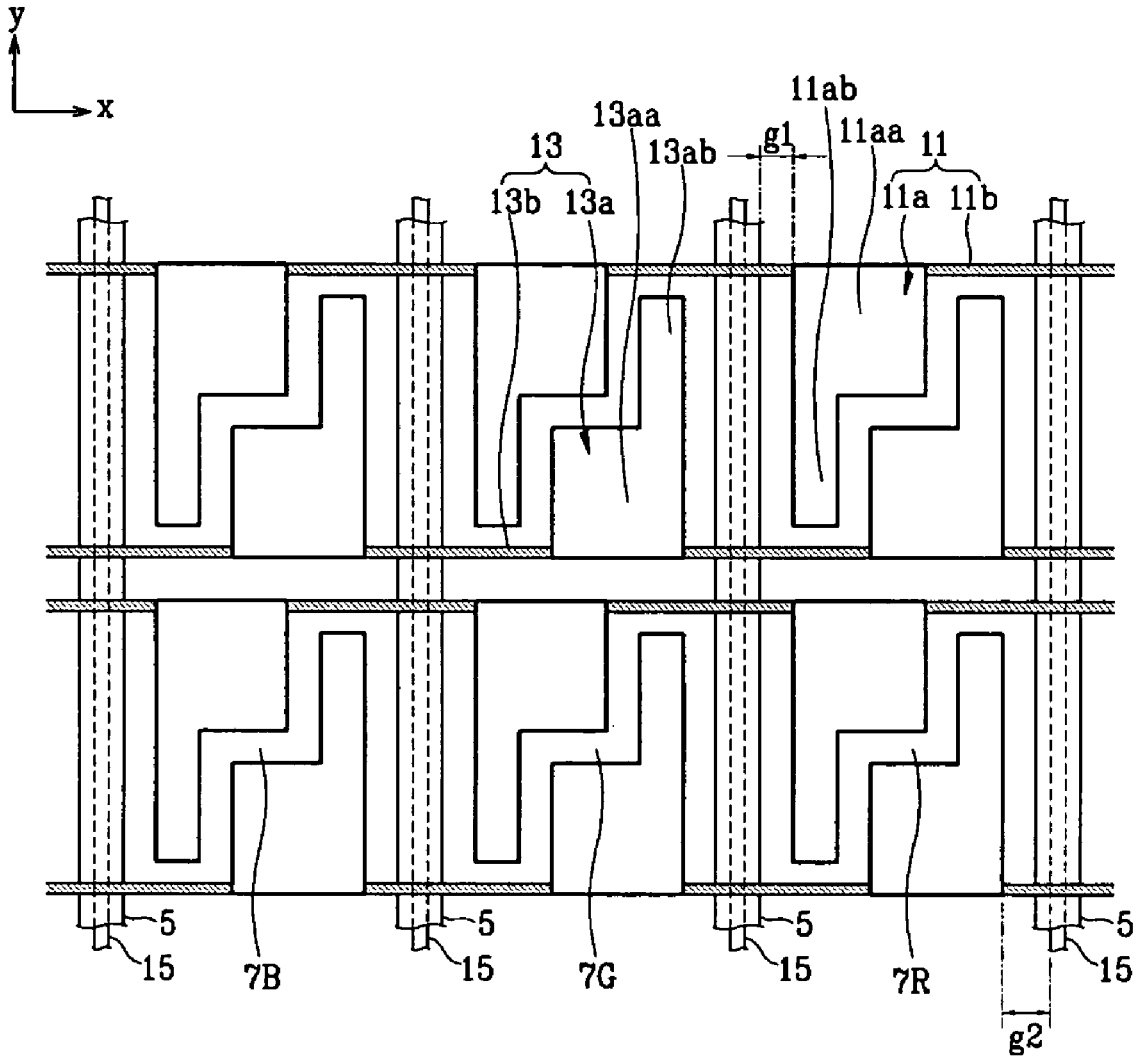
FIG. 5 is a partial plan view of the plasma display panel according to the first exemplary embodiment of the present invention.

FIG. 5 is a partial plan view of the PDP according to the first exemplary embodiment of the present invention.

As a result of the formation of the address electrodes 15 as described in FIGS. 1, 2, and 3, the display electrodes 11, 13 have a configuration as shown in FIG. 5. In more detail, the bus electrodes 11*b*, 13*b* are formed extending along direction x as described above, and the transparent electrodes 11*a*, 13*a* are formed respectively from the bus electrodes 11*b*, 13*b* extending along direction y. For each of the discharge cells 7R, 7G, 7B, a pair of one of each of the transparent electrodes 11*a*, 13*a* oppose one another in such a manner that there is a point symmetry (or is substantially unchanged in appearance by a 180 degree rotation) between the pair of the transparent electrodes 11*a*, 13*a*.

The transparent electrodes 11*a*, 13*a* include wide regions 11*aa*, 13*aa* that are in contact with the bus electrodes 11*b*, 13*b* and extend toward inner areas of the discharge cells 7R, 7G, 7B, and narrow regions 11*ab*, 13*ab* that extend further into the discharge cells 7R, 7G, 7B from the wide regions 11*aa*, 13*aa*.

The wide regions 11*aa*, 13*aa* and the narrow regions 11*ab*, 13*ab* of the transparent electrodes 11*a*, 13*a* result in a stepped configuration of the transparent electrodes 11*a*, 13*a*. The wide regions 11*aa*, 13*aa* and the narrow regions 11*ab*, 13*ab* increase discharge efficiency by enlarging a surface discharge region of the transparent electrodes 11*a*, 13*a*.

The wide regions 11*aa*, 13*aa* and the narrow regions 13*ab*, 11*ab*, respectively, have an opposing structure along the direction of extension of the bus electrodes 11*b*, 13*b* (i.e., along direction x), and the wide region 11*aa* and the wide region 13*aa* have an opposing structure along the direction of extension of the address electrodes 15 (i.e., along direction y). That is, the transparent electrodes 11*a*, 13*a* have opposing structures along both directions x, y.

With the transparent electrodes 11*a*, 13*a* formed opposing one another along direction x and extending along direction y, the transparent electrodes 11*a* of the X electrodes 11, which are not involved in address discharge, are provided such that there are sufficient gaps g1,g2 between the transparent electrodes 11*a* and the barrier ribs 5 (g1), and between the transparent electrodes 11*a* and the address electrodes 15 (g2). This prevents mis-discharge from occurring with the address electrodes 15, which are formed in the barrier ribs 5.

Figure 6:
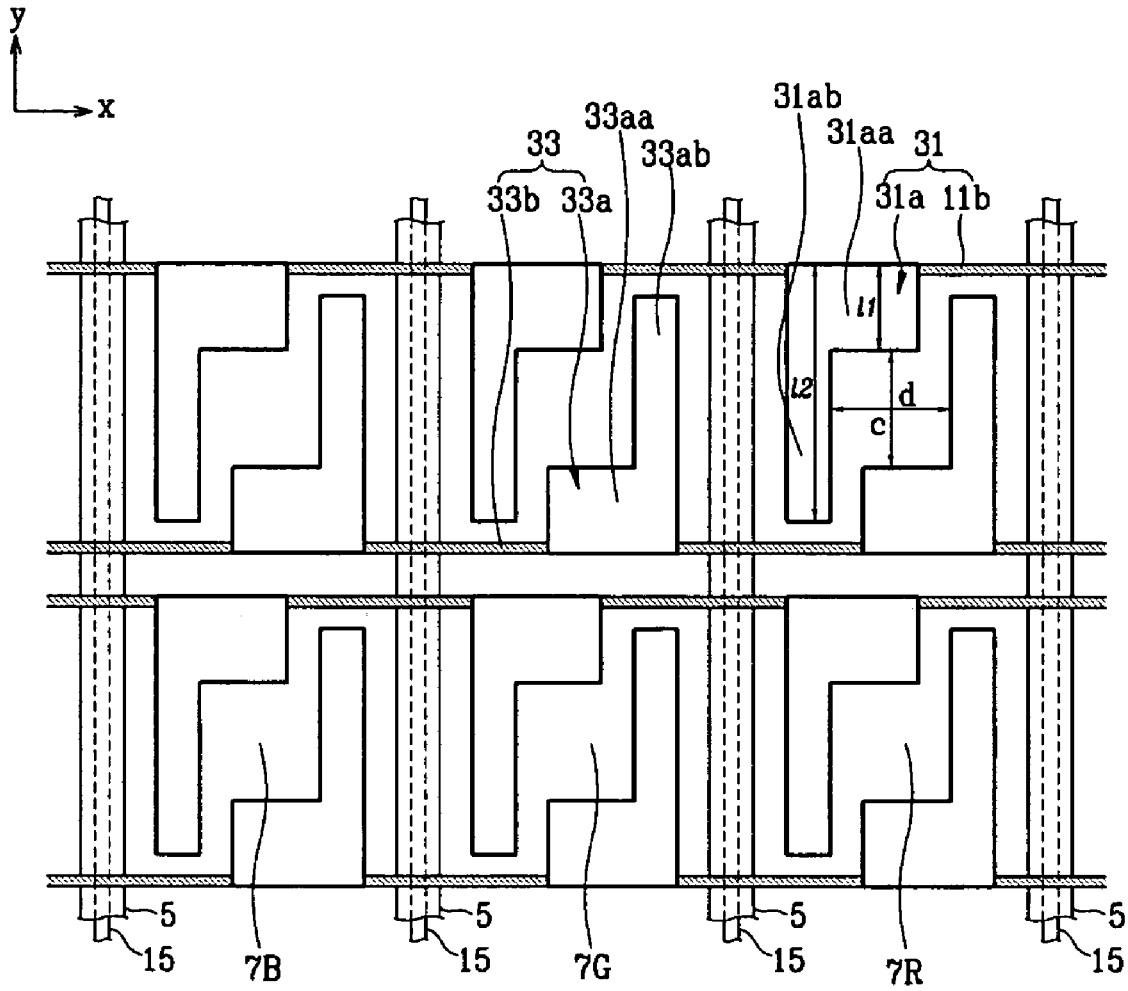
FIG. 6 is a partial plan view of a plasma display panel according to a second exemplary embodiment of the present invention.

FIG. 6 is a partial plan view of a PDP according to a second exemplary embodiment of the present invention.

With reference to FIG. 6, transparent electrodes 31*a*, 33*a* of the PDP of this embodiment include wide regions 31*aa*, 33*aa* with a length 11 along direction y that is significantly less than a length 12 of narrow regions 31*ab*, 33*ab* along the same direction. As a result, a space having a gap c between each opposing pair of the wide regions 31*aa*, 33*aa*, and a space having a gap d between each opposing pair of the narrow regions 33*ab*, 31*ab* are formed as long discharge gaps. Wide phosphor material regions of the discharge cells 7R, 7G, 7B corresponding to these discharge gaps c, d are excited to thereby improve discharge efficiency.

Figure 7:
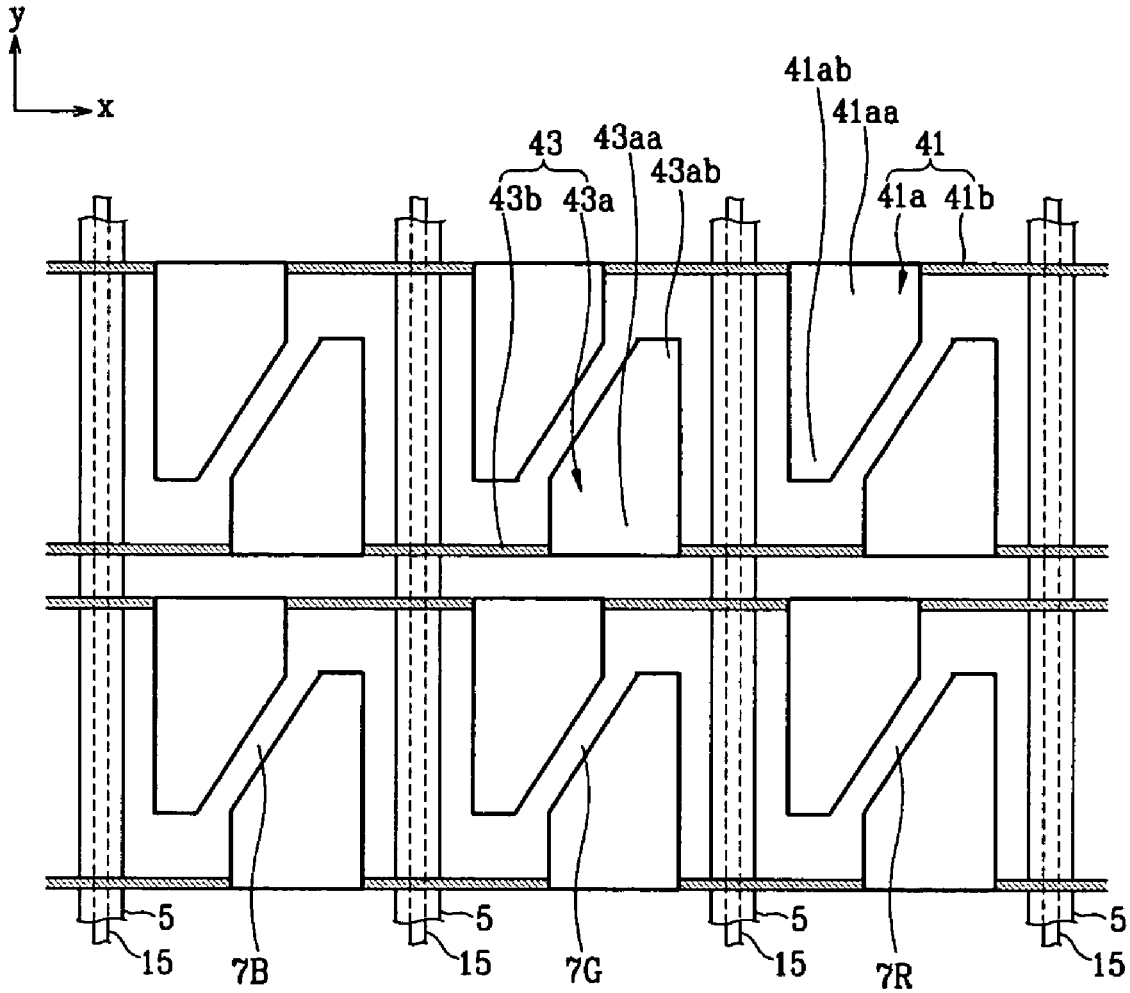
FIG. 7 is a partial plan view of a plasma display panel according to a third exemplary embodiment of the present invention.

FIG. 7 is a partial plan view of a PDP according to a third exemplary embodiment of the present invention.

Transparent electrodes 41*a*, 43*a* of the PDP of this embodiment include wide regions 41*aa*, 43*aa* and narrow regions 41*ab*, 43*ab* and have an inclined structure. That is, for each of the transparent electrodes 41*a*, 43*a*, surfaces interconnecting the wide regions 41*aa*, 43*aa* and the narrow regions 41*ab*, 43*ab* are inclined (or sloped) with respect to both directions x and y. The wide regions 11*aa*, 13*aa* and the narrow regions 11*ab*, 13*ab* with this inclined structure result in the formation of large discharge regions (gaps) of the transparent electrodes 41, 43 similar to those discharge gaps discussed above for FIGS. 5 and 6 to thereby enhance discharge efficiency.

Figure 8:
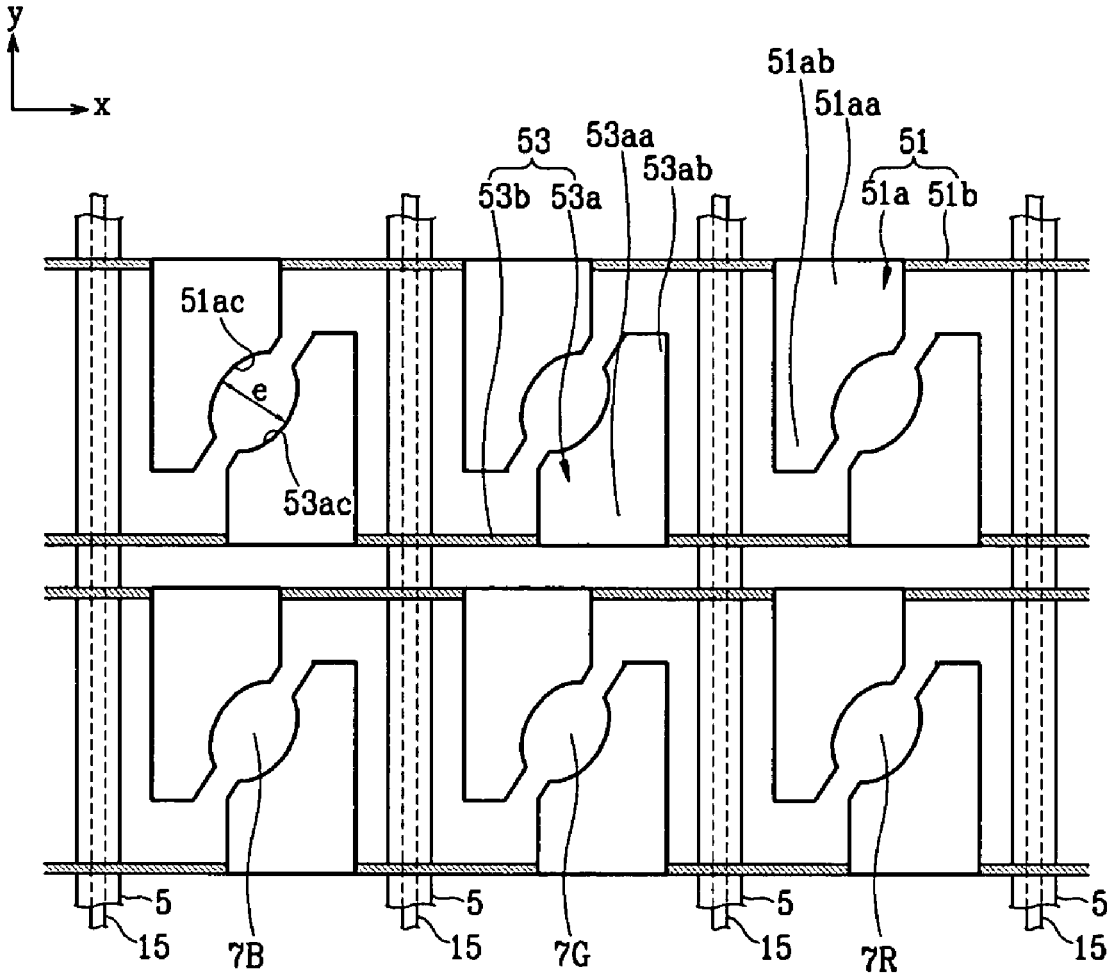
FIG. 8 is a partial plan view of a plasma display panel according to a fourth exemplary embodiment of the present invention.

FIG. 8 is a partial plan view of a PDP according to a fourth exemplary embodiment of the present invention.

With reference to the drawing, surfaces interconnecting wide regions 51*aa*, 53*aa* and narrow regions 51*ab*, 53*ab* of transparent electrodes 51*a*, 53*a* of the PDP of this embodiment include opposing rounded segments 51*ac*, 53*ac*. The rounded segments 51*ac*, 53*ac* formed a long discharge gap e between the surfaces connecting the wide regions 51*aa*, 53*aa* and the narrow regions 51*ab*, 53*ab*.

Pairs of the X and Y electrodes in the first to fourth exemplary embodiments have point symmetries with respect to the centers of the discharge cells 7R, 7G, 7B as shown in FIGS. 5-8. However, each of the X electrodes and Y electrodes is asymmetrical with respect to the direction x and the direction y or is asymmetrically formed with respect to direction y along which the address electrodes 15 are extended, as well as with respect to direction x along which the bus electrodes are extended to thereby increase opposing areas to result in inducing plasma discharge over a large area and enhance discharge efficiency.

FIGS. 9A-9D are partial sectional views of a PDP as it undergoes sequential manufacturing steps according to an exemplary method of the present invention. A method of forming the transparent electrodes 11*a*, 13*a* having the advantages as discussed above will be described with reference to the drawings.

The formation of the barrier ribs 5, the transparent electrodes 11*a*, 13*a*, and related elements will be described in more detail below, with the understanding that there may be parts shown in drawings, or parts not shown in the drawings, that are not discussed in the specification, as they are not essential to a complete understanding of the invention.

In the PDP manufacturing method, display electrodes 11, 13 are formed on the first substrate 1, and the barrier ribs 5 and the address electrodes 15 are formed on the second substrate 3. The first and second substrates 1, 3 are then sealed opposing one another.

Figure 9A:
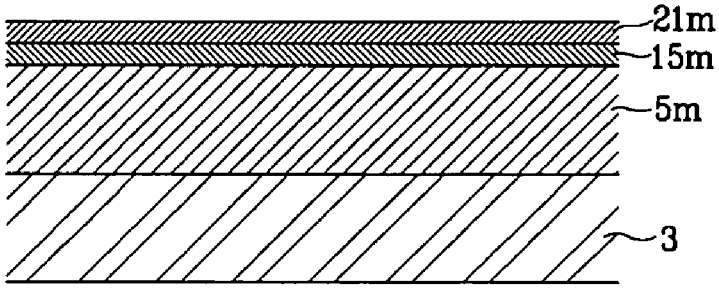
FIGS. 9A-9D are partial sectional views of a plasma display panel as it undergoes sequential manufacturing steps according to an exemplary method of the present invention.

Referring to FIG. 9A, the barrier ribs 5 are formed by depositing a barrier rib material 5*m*, an address electrode material 15*m*, and a dielectric material 21*m* in this order on the second substrate 3 to thereby result in a multilayer structure. In this multilayer structure formation step, deposition of the dielectric material 21*m* may be selectively performed as needed (e.g., deposition of the dielectric material 21*m* may be omitted from the process).

Figure 9B:
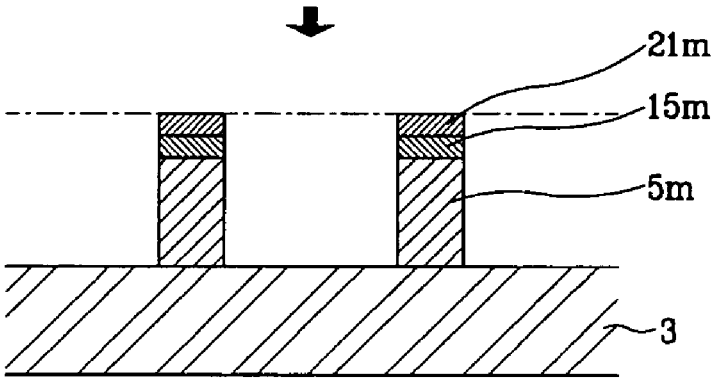

Next, areas of the multilayer structure that include the barrier rib material 5*m*, the address electrode material 15*m*, and the dielectric material 21*m* not corresponding to where the barrier ribs 5 are to be formed, that is, corresponding to where the discharge cells 7R, 7G, 7B are to be formed are removed as shown in FIG. 9B. In this removal step, a sub-step of removing the dielectric material 21*m* is unneeded when the same is not deposited in the multilayer structure formation step. Removal may be performed by sandblasting, etching, laser etching, and other methods know to those skilled in the art.

Figure 9C:
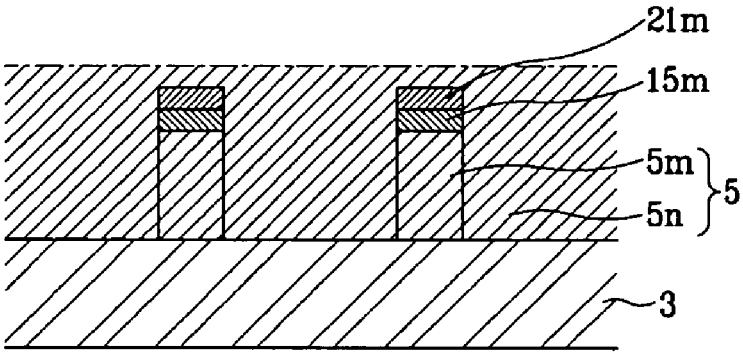

Subsequently, with reference to FIG. 9C, a barrier rib material layer 5*n* is deposited on the second substrate 3 covering all elements left remaining thereon. In one embodiment, the barrier rib material layer 5*n* is formed covering also side surfaces of the barrier rib material 5*m*, the address electrode material 15*m*, and the dielectric material 21*m*.

Figure 9D:
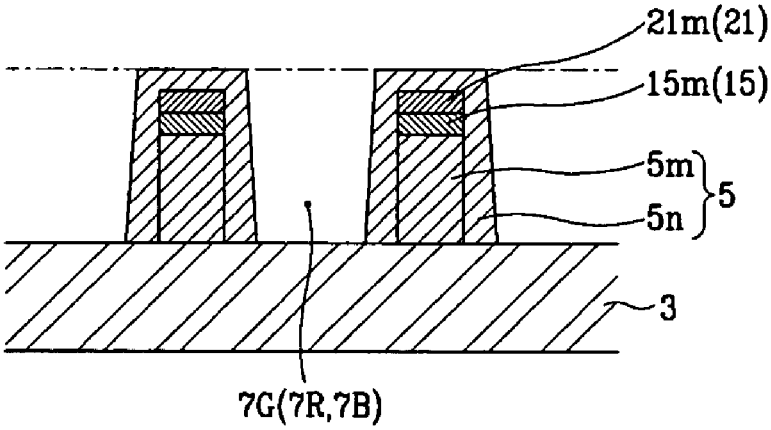

Following the above step, areas of the barrier rib layer 15*n* not corresponding to where the barrier ribs 5 are to be formed, that is, corresponding to where the discharge cells 7R, 7G, 7B are to be formed are removed as shown in FIG. 9D. This results is a configuration in which the address electrodes 15 and the first dielectric layers 21 are formed in this sequence embedded within the barrier ribs 5.

The address electrodes 15 formed in this manner do not undergo mis-discharge with the X electrodes 11, and are positioned in close proximity to the Y electrodes 13 to enable low-voltage address discharge.

Methods substantially similar to the above method may also be applied to manufacture the PDP of the second, third, and fourth embodiments of FIGS. 5-8 of the present invention.

In a PDP of the present invention described above, address electrodes are positioned close to a substrate on which display electrodes are mounted to reduce the distance between the electrodes responsible for address discharge and thereby allow for low-voltage driving. That is, in one embodiment, the address electrodes are formed in the barrier ribs of the second substrate, and the Y electrodes are formed on the first substrate opposing the address electrodes. Alternatively, in another embodiment, the address electrodes and the Y electrodes are both formed on the first substrate. In either case, the discharge distance between the address electrodes and the Y electrodes are reduced such that low-voltage address discharge is possible, thereby reducing the power consumption of the PDP.

While this invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A plasma display panel, comprising:

a first substrate and a second substrate opposing one another with a gap therebetween;

a plurality of barrier ribs in the gap between the first substrate and the second substrate to configure a plurality of discharge cells;

one of a plurality of phosphor layers formed in each of the discharge cells;

a plurality of display electrodes on the first substrate along a first direction; and a plurality of address electrodes between the first substrate and the second substrate along a second direction, the second direction intersecting the first direction, wherein the address electrodes are closer to the first substrate than to the second substrate.

2. The plasma display panel of claim 1, wherein the address electrodes are respectively in upper regions of the baffler ribs.

3. The plasma display panel of claim 1, wherein the address electrodes are embedded within the barrier ribs.

4. The plasma display panel of claim 1, wherein the address electrodes extend along the baffler ribs corresponding to all of the display electrodes.

5. The plasma display panel of claim 1, further comprising a dielectric layer on the first substrate, wherein the address electrodes are connected to the first substrate via the dielectric layer, and are closer to the display electrodes than to the first substrate while being electrically isolated from the display electrodes.

6. The plasma display panel of claim 5, wherein the dielectric layer comprises a plurality of protrusions, wherein the address electrodes are embedded within the protrusions, and wherein the address electrodes are closer to the second substrate than the display electrodes are to the second substrate.

7. The plasma display panel of claim 1, wherein the display electrodes include a plurality of bus electrodes extending along the first direction, and in opposing pairs for each of the discharge cells, and a plurality of transparent electrodes on the first substrate and extended toward inner regions of each of the discharge cells from the bus electrodes, a pair of the transparent electrodes opposing one another for each of the discharge cells, each opposing pair of the transparent electrodes having a point symmetry with respect to a center of a corresponding one of the discharge cells.

8. A plasma display panel, comprising:

a first substrate and a second substrate opposing one another with a gap therebetween;

a plurality of barrier ribs in the gap to configure a plurality of discharge cells;

one of a plurality of phosphor layers in each of the discharge cells;

a plurality of display electrodes on the first substrate along one direction; and a plurality of address electrodes between the first substrate and the second substrate and at a distance from the second substrate, each address electrode being aligned over or within a barrier rib, wherein the display electrodes include a plurality of bus electrodes extending along the one direction, and in opposing pairs for each of the discharge cells, and a plurality of protruding electrodes on the first substrate and extended toward inner regions of each of the discharge cells from the bus electrodes, a pair of the protruding electrodes opposing one another for each of the discharge cells, each opposing pair of the protruding electrodes having a point symmetry with respect to a center of a corresponding one of the discharge cells.

9. The plasma display panel of claim 8, wherein each of the protruding electrodes includes a wide region for connection to a corresponding one of the bus electrodes and extends into one of the discharge cells, and a narrow region extended from the wide region and further into the discharge cell.

10. The plasma display panel of claim 8, wherein each of the protruding electrodes includes a wide region and a narrow region, the wide region and the narrow region forming a stepped structure.

11. The plasma display panel of claim 8, wherein each of the protruding electrodes includes a wide region and a narrow region, the wide region and the narrow region opposing each other along a direction of extension of the bus electrodes, the wide region and the narrow region also opposing each other along a direction of extension of the address electrodes.

12. The plasma display panel of claim 8, wherein each of the protruding electrodes includes a wide region and a narrow region, the wide region having a length along a direction of extension of the address electrodes that is less than a length of the narrow region along the same direction of extension of the address electrodes.

13. The plasma display panel of claim 8, wherein each of the protruding electrodes includes a wide region and a narrow region interconnected by an inclined surface.

14. The plasma display panel of claim 13, wherein the inclined surface is inclined surface is inclined with respect to a direction of extension of the bus electrodes and a direction of extension of the address electrodes.

15. The plasma display panel of claim 13, wherein the inclined surface includes a rounded segment, rounded segments for each pair of the protruding electrodes opposing one another.

16. The plasma display panel of claim 8, wherein opposing pairs of the protruding electrodes are included in pairs of sustain and scan electrodes, each pair of the sustain and scan electrodes having a point symmetry with respect to a center of a corresponding one of the discharge cells.

17. The plasma display panel of claim 16, wherein the sustain and scan electrodes have an asymmetrical structure with respect to a direction of extension of the address electrodes, and with respect to a direction of extension of the bus electrodes.

18. The plasma display panel of claim 8, wherein the address electrodes are in upper regions of the barrier ribs.

19. The plasma display panel of claim 8, wherein the address electrodes are embedded within the barrier ribs.

20. The plasma display panel of claim 8, wherein the address electrodes extend along the barrier ribs corresponding to all of the display electrodes.

21. The plasma display panel of claim 8, further comprising a dielectric layer on the first substrate, wherein the address electrodes are connected to the first substrate via the dielectric layer, and are closer to the display electrodes than to the first substrate while being electrically isolated from the display electrodes.

22. The plasma display panel of claim 21, wherein the dielectric layer comprises a plurality of protrusions, wherein the address electrodes are embedded within the protrusions, and wherein the address electrodes are closer toward the second substrate than the display electrodes are toward the second substrate.

23. A plasma display panel, comprising:

a first substrate and a second substrate;

a barrier rib between the first substrate and the second substrate;

a pair of display electrodes on the first substrate along a first direction; and an address electrode between the first substrate and the second substrate along a second direction, wherein the address electrode is closer to the first substrate than to the second substrate, and wherein the pair of display electrodes have an asymmetrical structure with respect to the first direction and the second direction.

24. The plasma display panel of claim 23, wherein the pair of display electrodes have a pair bus electrodes extending along the first direction and a pair of protruding electrodes extending along the second direction, the pair of protruding electrodes having a point symmetry with respect to a center of a corresponding discharge cell.

25. The plasma display panel of claim 24, wherein the pair of protruding electrodes have an asymmetrical structure with respect to the first direction and the second direction.

* * * * *

UNITED STATES PATENT AND TRADEMARK OFFICE

CERTIFICATE OF CORRECTION

PATENT NO. : 7,425,796 B2
APPLICATION NO. : 11/111242
DATED : September 16, 2008
INVENTOR(S) : Takahisa Mizuta It is certified that error appears in the above-identified patent and that said Letters Patent is hereby corrected as shown below:

In the Claims

| | |
|---|---|
| Column 8, line 59, Claim 2 | Delete "baffler",<br>Insert --barrier-- |
| Column 8, line 63, Claim 4 | Delete "baffler",<br>Insert --barrier-- |
| Column 10, line 13, Claim 14 | Delete "surface is inclined with respect to",<br>Insert --with respect to-- |
| Column 11, line 2, Claim 24 | Delete "pair bus",<br>Insert --pair of bus-- |

Signed and Sealed this

Thirteenth Day of January, 2009

JON W. DUDAS
*Director of the United States Patent and Trademark Office*